US010716412B2

(12) United States Patent
Pena

(10) Patent No.: US 10,716,412 B2
(45) **Date of Patent: *Jul. 21, 2020**

(54) DISPLAY RACK SYSTEM

(71) Applicant: TracFone Wireless, Inc., Miami, FL (US)

(72) Inventor: Elvis Pena, Miami, FL (US)

(73) Assignee: TracFone Wireless, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/545,516

(22) Filed: Aug. 20, 2019

(65) Prior Publication Data

US 2019/0365120 A1 Dec. 5, 2019

Related U.S. Application Data

(63) Continuation of application No. 15/925,373, filed on Mar. 19, 2018, now Pat. No. 10,383,460, which is a continuation of application No. 15/265,334, filed on Sep. 14, 2016, now Pat. No. 9,918,567.

(60) Provisional application No. 62/218,771, filed on Sep. 15, 2015.

(51) Int. Cl.

| | |
|---|---|
| ***A47F 5/02*** | (2006.01) |
| ***A47F 5/00*** | (2006.01) |
| ***A47F 5/08*** | (2006.01) |
| ***A47F 7/14*** | (2006.01) |

(52) U.S. Cl.

CPC ..... *A47F 5/0093* (2013.01); *A47F 5/0025* (2013.01); *A47F 5/0087* (2013.01); *A47F 5/02* (2013.01); *A47F 5/08* (2013.01); *A47F 5/0807* (2013.01); *A47F 7/146* (2013.01); *A47F 5/0037* (2013.01)

(58) Field of Classification Search

CPC ..... A47F 5/0087; A47F 5/02; A47F 5/025; A47F 5/05; A47F 5/0093; A47F 7/146; A47F 5/08; A47F 5/0025; A47F 5/0037; A47F 7/16; A47F 7/163; A47F 5/04; A47F 5/0807; A47F 5/0043; A47F 5/0081; A47F 5/01; A47F 5/083; A47F 5/101; A47F 5/103; A47B 49/00; A47B 49/004

USPC ..... 211/163, 95, 96, 78, 131.1, 58, 105.3, 211/115, 144, 162, 166, 182, 50, 56, 211/87.01, 169, 195, 45, 51–55

See application file for complete search history.

(56) References Cited

U.S. PATENT DOCUMENTS

| | | | |
|---|---|---|---|
| 1,432,286 | A | 10/1922 | Samuel et al. |
| 1,997,829 | A | 4/1935 | Mckee et al. |
| 2,008,303 | A | 7/1935 | Lay et al. |
| 2,171,110 | A | 8/1939 | Feicht et al. |
| 2,683,891 | A | 7/1954 | Rosenbaum et al. |
| 2,690,136 | A | 9/1954 | Alfred et al. |
| 3,170,741 | A | 2/1965 | Richards et al. |

(Continued)

*Primary Examiner* — Hiwot E Tefera

(74) *Attorney, Agent, or Firm* — BakerHostetler

(57) ABSTRACT

The disclosure provides for a display rack system. The display rack system includes a support mechanism having first and second ends. The support mechanism may be configured to be attached to a surface at the first and second ends. The display rack system may also include a track mounted onto the support mechanism. The display rack system may also include a plurality of cardholders attached to the track. Each of the first plurality of cardholders may be configured to independently slide laterally relative to the track.

20 Claims, 7 Drawing Sheets

(56) References Cited

U.S. PATENT DOCUMENTS 3,430,908 A 3/1969 Kowalczyk et al.
3,563,182 A 2/1971 Macfarlane et al.
3,642,338 A 2/1972 Humphrey et al.
3,780,852 A 12/1973 Weiss et al.
3,844,230 A * 10/1974 Hudson ..... A47F 5/02 108/60
3,924,749 A * 12/1975 Weston ..... A47F 5/04 211/4
3,942,647 A 3/1976 Crosslen
3,983,649 A * 10/1976 Ellis ..... B42F 17/32 40/122
4,079,841 A 3/1978 Castel
4,126,366 A * 11/1978 Handler ..... A47F 5/02 108/152
4,140,223 A 2/1979 Rau et al.
4,247,010 A 1/1981 Eckert
4,432,151 A * 2/1984 Morris ..... G09F 23/06 211/131.1
4,442,942 A 4/1984 Cuminale et al.
4,841,654 A * 6/1989 Hodgson ..... A47F 5/02 40/584
4,913,297 A 4/1990 Wells
4,938,366 A 7/1990 Carroll
4,961,295 A 10/1990 Kosch, Sr. et al.
4,976,359 A 12/1990 Hardy
4,982,852 A 1/1991 Johansen
5,031,779 A * 7/1991 Szenay ..... A47F 5/02 211/163
5,139,155 A * 8/1992 Laxson ..... A47F 5/0087 211/169
5,226,548 A * 7/1993 Koeppel ..... A47F 5/02 211/144
5,328,037 A 7/1994 Fujii
5,462,178 A * 10/1995 Wallach ..... A47F 5/02 211/163
5,494,177 A 2/1996 Todd, Jr.
5,505,319 A * 4/1996 Todd, Jr. ..... A47F 5/04 211/163
5,551,577 A 9/1996 Hagopian
5,586,664 A 12/1996 Taylor
5,611,440 A * 3/1997 Møller ..... A47B 45/00 108/181
5,971,169 A * 10/1999 Orr ..... A47F 5/02 211/163
5,992,651 A 11/1999 Shaw et al.
6,015,051 A 1/2000 Battaglia
6,070,747 A 6/2000 Shea
6,279,761 B1 8/2001 Niewiadomski et al.
6,336,564 B1 1/2002 Garnier
6,951,291 B2 * 10/2005 Kleanthis ..... G09F 15/00 211/163
7,604,131 B1 10/2009 Clark et al.
7,775,379 B2 8/2010 Hodge
7,975,643 B1 7/2011 Johnson
8,550,263 B2 10/2013 Martin
8,596,599 B1 12/2013 Carson et al.
8,714,374 B2 5/2014 Bauchet et al.
2001/0047974 A1 * 12/2001 Berlingieri ..... A47F 5/08 211/106
2002/0139761 A1 10/2002 Nadeau
2002/0162812 A1 * 11/2002 Humphrey ..... A47F 5/02 211/85.14
2003/0196978 A1 * 10/2003 Humphrey ..... A47F 5/02 211/163
2004/0084393 A1 * 5/2004 Varga ..... B65F 1/141 211/78
2004/0245197 A1 12/2004 McElvaney
2005/0098519 A1 5/2005 Robbins
2005/0230338 A1 10/2005 Farinola et al.
2005/0247653 A1 11/2005 Brooks
2006/0186063 A1 * 8/2006 Campbell ..... A47F 5/02 211/55
2007/0158288 A1 7/2007 Rotolo
2008/0053932 A1 3/2008 Newbould et al.
2011/0062094 A1 * 3/2011 Levine ..... A47F 5/02 211/58
2012/0193312 A1 * 8/2012 Sjolander ..... A47F 1/12 211/59.2

* cited by examiner

DISPLAY RACK SYSTEM

CROSS REFERENCE TO PRIOR APPLICATIONS

This application is a continuation of the U.S. patent application Ser. No. 15/925,373, filed Mar. 19, 2018 now U.S. Pat. No. 10,383,460 issued Aug. 20, 2019, which is incorporated herein by reference in its entirety; which is a continuation of the U.S. patent application Ser. No. 15/265,334, filed Sep. 14, 2016 now U.S. Pat. No. 9,918,567 issued Mar. 20, 2018, which is incorporated herein by reference in its entirety. This application also claims the benefit from U.S. Provisional Application No. 62/218,771 filed on Sep. 15, 2015, which is hereby incorporated by reference for all purposes as if fully set forth herein.

BACKGROUND OF THE DISCLOSURE

1. Field of the Disclosure

The disclosure generally relates to a display rack system. Specifically, the disclosure relates to display rack system with a plurality of modular cardholders.

2. Related Art

In retail stores such as department stores, supermarkets, convenience stores, and the like, display racks are placed in the stores, and commercial goods are displayed on the display racks. These display racks are typically configured to display merchandise in a fixed location with set amount of space to enable a customer to see the merchandise and select items prior to purchasing. Often, retailers may have limited physical space allocated for the display of a particular product. Moreover, many retailers are utilizing shorter displays thus reducing the display area for merchandise.

Accordingly, there is a need for a display rack system that is able to hold a greater number of items in a limited space while allowing customers easy access to all of the items.

SUMMARY OF THE INVENTION

To meet the foregoing needs, the present disclosure describes a display rack system that includes a support mechanism having first and second ends. The support mechanism may be configured to be attached to a surface at the first and second ends. The display rack system may also include a track mounted onto the support mechanism. The display rack system may also include a plurality of cardholders removably attached to the track. Each of the plurality of cardholders may be configured to independently slide laterally relative to the track. The display rack system may also include a plurality of rotatable cardholders. Each of the plurality of rotatable cardholders may be configured to hold a plurality of products and independently rotate in order to allow customer to view the plurality of products.

The track may include a plurality of tiered parallel bars. The track may have a discorectangular shape. The track may be expandable in a telescoping manner. Each of the first plurality of cardholders may include a handle portion. Each of the plurality of cardholders may include an engagement mechanism, such as a wheel, configured to slide along the track. The wheel may be coupled to each of the plurality of cardholders. The display rack system may further include a plurality of cardholders removably attached to a second track mounted on the support mechanism. The plurality of cardholders may be configured to hold cards. The plurality of cardholders may be configured to hold a plurality of signs.

In one aspect, a display rack system includes a support mechanism having first and second ends, the support mechanism configured to be attached to a surface at the first and second ends, a track mounted onto the support mechanism, and a plurality of cardholders attached to the track, each of the plurality of cardholders configured to independently slide laterally along the track relative to the support mechanism.

The track may further include a plurality of vertically tiered parallel bars, wherein a first set of the plurality of cardholders are arranged on a first set of the vertically tiered parallel bars, and wherein a second set of the plurality of cardholders are arranged on a second set of the vertically tiered parallel bars. The track may have a discorectangular shape. The track may be expandable in a telescoping manner. The at least one of the plurality of cardholders may include a handle portion. The plurality of cardholders may include at least one wheel configured to slide along the track. The support mechanism may be configured to be expandable in a telescoping manner. The support mechanism may be configured to engage a vertically arranged to rail. The plurality of cardholders may be configured to hold cards. The plurality of cardholders may be configured to hold a sign.

In another aspect, a display rack system includes a support mechanism having first and second ends, the support mechanism configured to be attached to a surface at the first and second ends, a track mounted onto the support mechanism, and a plurality of cardholders attached to the track, each of the plurality of cardholders configured to independently slide laterally along the track relative to the support mechanism, wherein the track further comprises a plurality of tiered parallel bars, wherein the track is expandable in a telescoping manner, wherein at least one of the plurality of cardholders includes a handle portion, and wherein the plurality of cardholders are configured to hold cards.

Each of the plurality of cardholders may include at least one wheel configured to slide along the track. The support mechanism may include configured to be expandable in a telescoping manner. The support mechanism may be configured to engage a vertically arranged to rail. The first plurality of cardholders may be configured to hold a sign.

In yet another aspect, a display rack system includes a support mechanism having first and second ends, the support mechanism configured to be attached to a surface at the first and second ends, a plurality of cardholders removably attached to the support mechanism, and a rotation mechanism configured to allow the plurality of cardholders to rotate with respect to the support mechanism.

The support mechanism may be expandable in a telescoping manner. At least one of the plurality of cardholders may include a handle portion. The plurality of cardholders may be configured to hold cards. The plurality of cardholders may be configured to hold a sign.

In another aspect, a display rack system, includes a support mechanism having first and second ends, the support mechanism configured to be attached to a surface at the first and second ends; a track mounted onto the support mechanism; and a first plurality of cardholders removably attached to the track, each of the first plurality of cardholders configured to independently slide laterally relative to the track, wherein the track further comprises a plurality of tiered parallel bars; wherein the track is expandable in a telescoping manner; wherein each of the first plurality of cardholders include a handle portion; and wherein the first plurality of cardholders are configured to hold cards.

The first plurality of cardholders may include a wheel configured to slide along the track. The wheel may be removably coupled to each of the first plurality of cardholders. The display rack system may further include a second plurality of cardholders removably attached to the track, each of the second plurality of cardholders having a width different that each of the first plurality of cardholders. The first plurality of cardholders may be configured to hold a plurality of signs.

In another aspect, a display rack system includes a support mechanism having first and second ends, the support mechanism configured to be attached to a surface at the first and second ends; a plurality of cardholders removably attached to the support mechanism; and a rotation mechanism configured to allow the plurality of cardholders to rotate with respect to the support mechanism.

The support mechanism may be expandable in a telescoping manner. Each of the plurality of cardholders may include a handle portion. The plurality of cardholders may be configured to hold cards. The plurality of cardholders may be configured to hold a plurality of signs.

There has thus been outlined, rather broadly, certain aspects of the disclosure in order that the detailed description thereof herein may be better understood and in order that the present contribution to the art may be better appreciated. There are, of course, additional aspects of the disclosure that will be described below and which will form the subject matter of the claims appended hereto.

Before explaining at least one aspect of the disclosure in detail, it is to be understood that the disclosure is not limited in its application to the details of construction and to the arrangements of the components set forth in the following description or illustrated in the drawings. The disclosure is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods, and systems for carrying out the several purposes of the disclosure. It is important, therefore, that the claims be regarded as including such equivalent constructions insofar as they do not depart from the spirit and scope of the disclosure.

DETAILED DESCRIPTION

Reference in this specification to "one aspect," "an aspect," "other aspects," "one or more aspects," or the like means that a particular feature, structure, or characteristic described in connection with the aspect is included in at least one aspect of the disclosure. The appearance of, for example, "in one aspect" in various places in the specification are not necessarily all referring to the same aspect, nor are separate or alternative aspects mutually exclusive of other aspects. Moreover, various features are described which may be exhibited by some aspects and not by others. Similarly, various requirements are described which may be requirements for some aspects but not other aspects.

Figure 1:
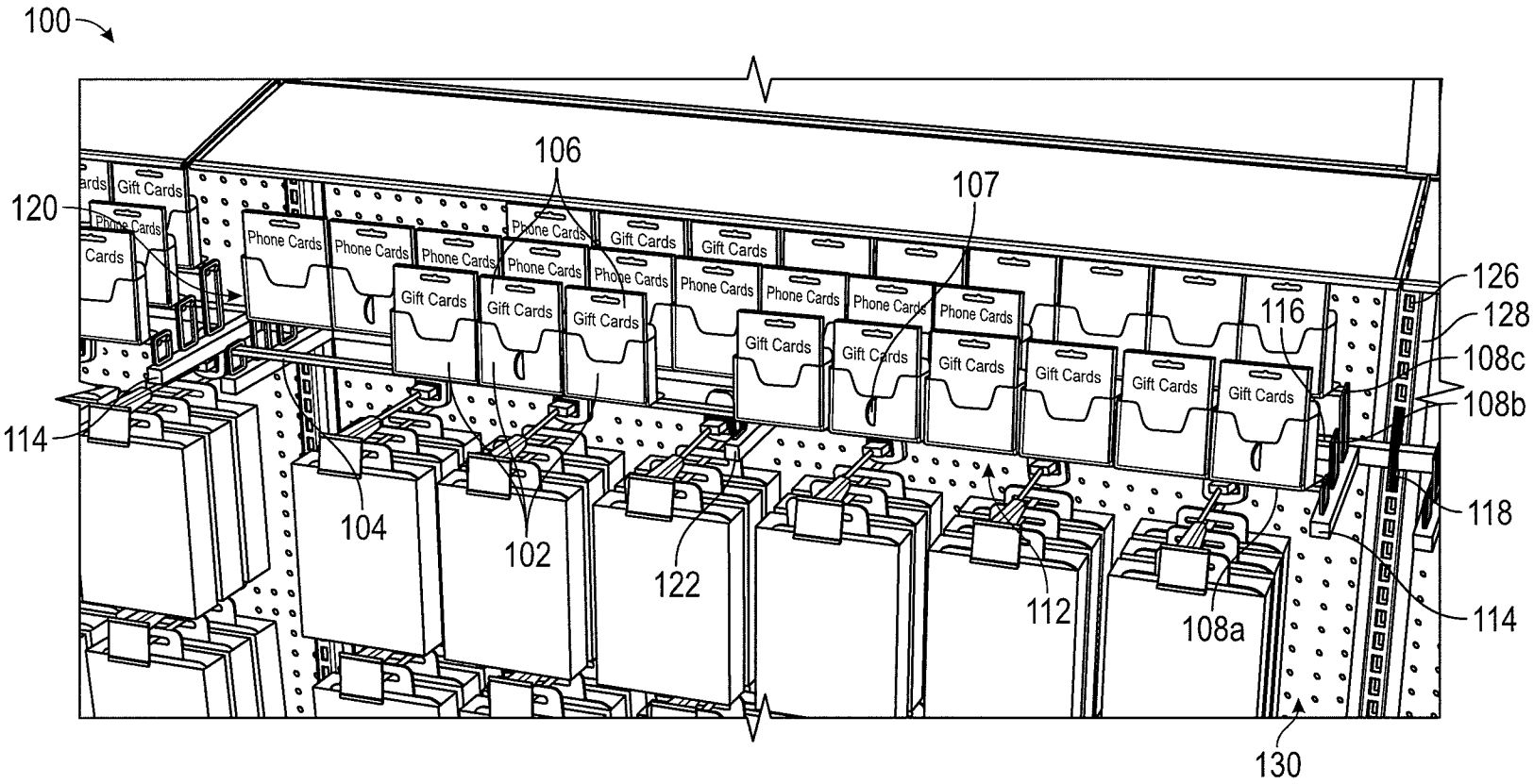
FIG. 1 illustrates a display rack system in accordance with an aspect of the disclosure.
Figure 2:
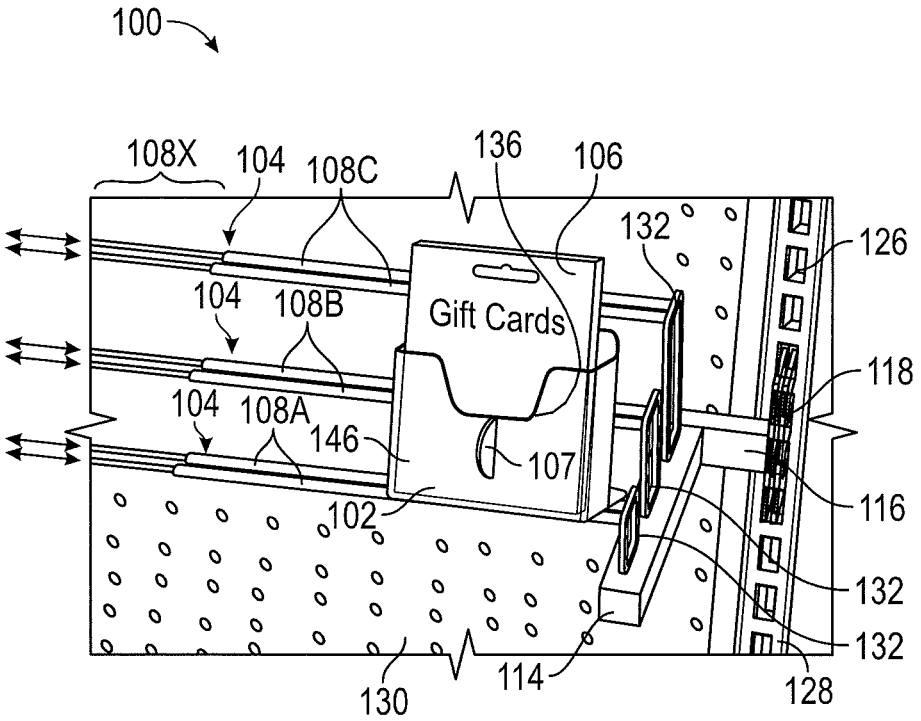
FIG. 2 illustrates details of the display rack system of FIG. 1.
Figure 3:
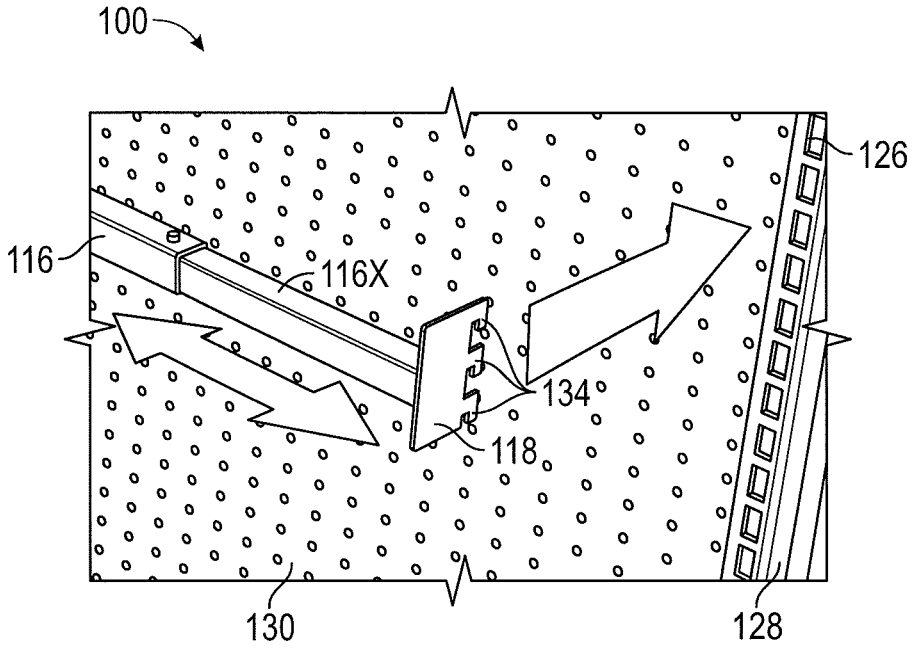
FIG. 3 illustrates further details of the display rack system of FIG. 1.
Figure 4:
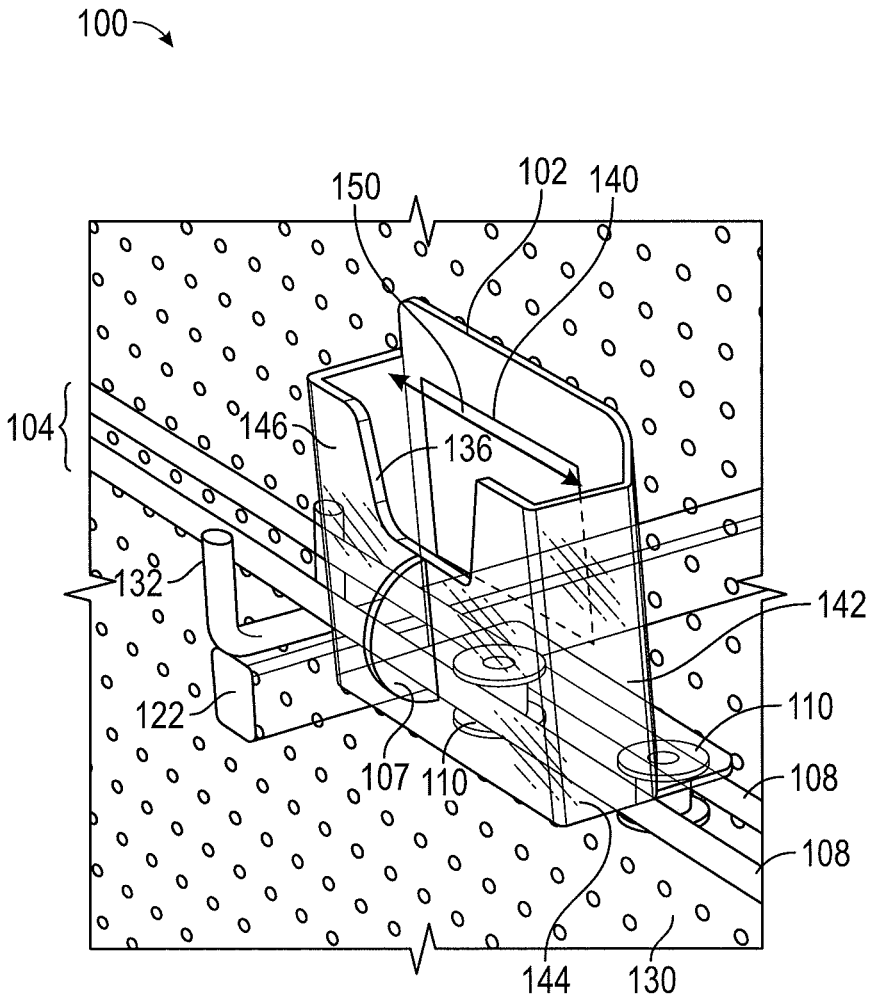
FIG. 4 illustrates further details of the display rack system of FIG. 1.

FIG. 1 illustrates a display rack system in accordance with an aspect of the disclosure; FIG. 2 illustrates details of the display rack system of FIG. 1; FIG. 3 illustrates further details of the display rack system of FIG. 1; and FIG. 4 illustrates further details of the display rack system of FIG. 1. In particular, FIGS. 1-4 illustrate a display rack system 100 that may include a plurality of cardholders 102. The cardholders 102 may each be removably attached to a track 104. Each of the cardholders 102 may include a mechanism to allow the cardholders 102 to slide along the track 104. The cardholders 102 may be configured to slide independently along the track 104. In one aspect, a plurality of the cardholders 102 may also be connected to one another and be configured to slide together along the track 104. The cardholders 102 may be used to hold and display items 106 such as phone cards, gift cards, cash cards, gas cards, etc. and/or signs and advertising for the foregoing. In one aspect, each of the cardholders 102 may include a handle 107 for a user to grasp and move the cardholder 102 left or right. In another aspect, only some of the cardholders 102 may include a handle 107 for a user to grasp and move the cardholder 102 left or right.

In one aspect, the cardholders 102 made from a clear material such as poly(methyl methacrylate), polycarbonate, butyrates including cellulose acetate butyrate, polyethylenes including glyocol modified polyethylene terphthalate (PETG), or another plastic material known in the art. In another aspect, the cardholders 102 may also be made from glass, such as laminated glass, toughened glass, coated glass, etc. The transparency of the cardholder 102 may allow a customer to more completely view the display items 106 when the display items 106 are placed inside of the cardholder 102. The cardholders 102 may include an open section 136. The open section 136 may facilitate viewing of the display items 106 and may facilitate a customer grasping the display items 106 and removing them from the cardholder 102. The cardholders 102 further include a back surface 140. The back surface 140 may support a back surface of the display items 106. Moreover, the back surface 140 may be configured to receive a sign 150 which is indicative of the display items 106. For example, the sign 150 may be an image of the display item 106. The sign 150 may be a card, plastic laminate, paper, or the like having an adhesive to adhere to the back surface 140. Accordingly, when the display items 106 have been completely removed from the cardholder 102, an individual restocking the cardholder 102 may easily recognize what type of display item 106 the cardholder 102 is meant to hold and may then easily restock the appropriate display item 106 into the cardholder 102. The cardholder 102 may further include side surfaces 142 connecting the back surface 140 to a front surface 146. The cardholder 102 may further include a closed bottom surface 144 that may connect to the back surface 140, the front surface 146, and the side surfaces 142.

The track 104 may include two parallel bars 108 configured to allow the cardholders 102 to slide along the track 104. The parallel bars 108 may be made from a metallic material, a plastic material, or the like. The track 104 may be implemented with other configurations. In one aspect, there may be an engagement mechanism 110 shown in FIG. 4 and FIG. 6 that may be coupled to the cardholders 102 that may connect to the parallel bars 108. The engagement mechanism 110 may be removably attached to the cardholders 102. The engagement mechanism 110 may be secured to the cardholders 102 by a thumbwheel, screw, adhesive, mechanical fastener, or another securement method known in the art. Alternatively, the engagement mechanism 110 may be molded from the same material as the cardholders 102. The engagement mechanism 110 may at least partially surround and engage the parallel bars 108 to the extent that the cardholder 102 is securely held by the parallel bars 108. Moreover, the engagement mechanism 110 may have a construction with a certain amount of clearance to allow the cardholder 102 to slide along the parallel bars 108. In one aspect, the engagement mechanism 110 may be one or more wheels that may freely rotate with respect to the cardholder 102. The rotating wheels may result in a reduced amount of friction between the cardholder 102 and the parallel bars 108. In one aspect, the wheels may be arranged as a pair of wheels. In this aspect, one wheel may contact one of the parallel bars 108 and the other wheel may contact the other one of the parallel bars 108.

In some aspects, it may be desirable that the track 104 is expandable in order to fit into display areas of various sizes and/or allow more/fewer cardholders 102 to fit onto the track 104. In those aspects, it may be desirable that the track 104 include telescoping parallel bars 108 having a telescoping portion 108X that may extend with a linear-motion or the like that allow the track 104 to extend different amounts depending on the size of the display area. In one aspect, the parallel bars 108 may be hollow tubes and the telescoping portion 108X may be a rod having a smaller diameter to be received within the hollow tube construction of the parallel bars 108. Other constructions are contemplated as well As shown in FIG. 1 and FIG. 2, the track 104 may include multiple tiers of parallel bars 108. In the aspect shown in FIGS. 1 and 2, the track 104 includes three tiers of parallel bars 108*a*, 108*b*, 108*c*. In other aspects, it may be desirable to have fewer or more than three tiers of parallel bars 108. The parallel bars 108*a*, 108*b*, 108*c* may be configured such that each tier of parallel bars 108*a*, 108*b*, 108*c* is at a different vertical height. For example, the tier of parallel bars 108*a* at the front 112 of the display rack system 100 may be at a lower height such that the cardholders 102 on the parallel bars 108*a* do not block a customer's view of cardholders 102 on subsequent tiers of the parallel bars 108*b* and 108*c*. Moreover, the cardholders 102 may be arranged on the track 104 with a predetermined number and spacing to allow movement of the cardholders 102 to gain access to the cardholders 102 on the other tiers. In other words, the cardholders 102 do not fully occupy the parallel bars 108 so that a customer may move and view the display items 106 on other tiers.

The track 104 may be mounted onto a support mechanism 114. The support mechanism 114 may be made from metal, plastic, or the like. In one aspect, the support mechanism 114 may be a hollow steel rectangular rod. The track 104 may be secured to the support mechanism 114 with vertical supports 132 using a screw, bolt, adhesive, mechanical fastener, or another securement method known in the art. The track 104 may be removably secured to the support mechanism 114 with the vertical supports 132 to allow different tracks to be quickly and easily swapped in and out.

The support mechanism 114 may include a rear rung 116 having ends 118 and 120. The support mechanism 114 may have a plurality of support arms 122 extending perpendicularly from the rear rung 116 between the support mechanisms 114. The rear rung 116 and support arms 122 may define a transverse plane. The cardholders 102 may be configured to slide along the track 104 parallel to the transverse plane. The support arms 122 may be removably coupled to the rear rung 116. The support arms 122 may be secured to the rear rung 116 using screws, adhesives, mechanical fasteners, welding, or other methods known in the art. In other aspects, the rear rung 116 and the support arms 122 may be made from a single component.

In some aspects, it may be desirable that the rear rung 116 is expandable in order to fit display areas of various sizes and/or allow more/fewer cardholders 102 to fit onto the track 104. In those aspects, it may be desirable that the rear rung 116 include a rear rung telescoping portion 116X with linear-motion or the like that allow the rear rung 116 to extend different amounts depending on the size of the display area.

The ends 118 and 120 of the support mechanism 114 may be configured to be mounted onto a rail, shelf, pegboard, or other surface. In one aspect, the ends 118 and 120 may be configured to fit into slots 126 formed into vertical rails 128. In one aspect, the ends 118 and 120 may include extensions 134 that extend into the slots 126. In other aspects, the rear rung may 116 include a plurality of pegboard pegs and may allow the display rack system 100 to be mounted onto a pegboard 130. Other constructions for attachment of the rear rung 116 are contemplated as well.

The rear rung 116 and ends 118 and 120 may form a single component. In other aspects, the ends 118 and 120 may each be a separate rail that extends from the rear rung 116.

Figure 5:
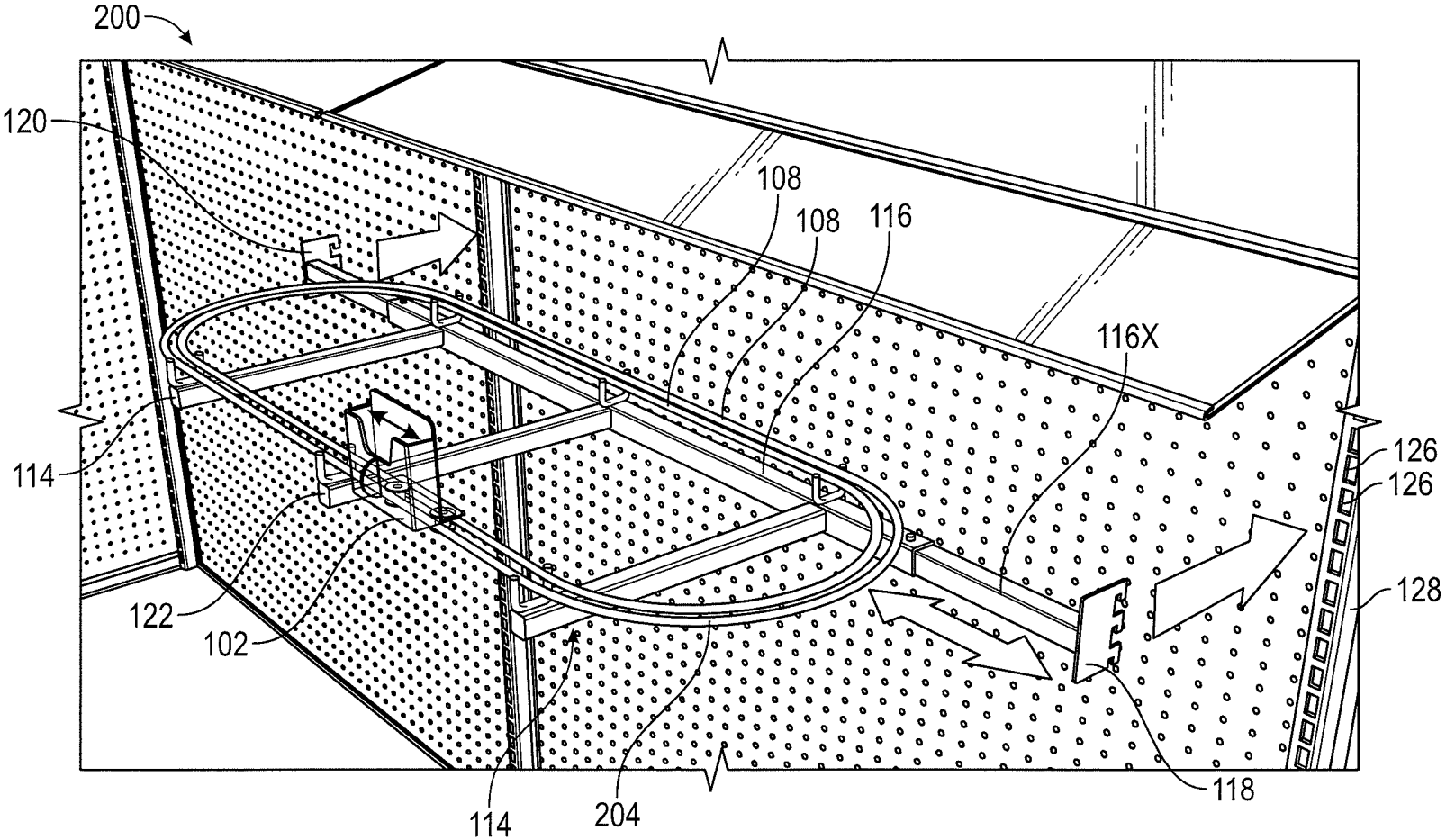
FIG. 5 illustrates a display rack system in accordance with another aspect of the disclosure.

FIG. 5 illustrates a display rack system 200 according to another aspect of the present disclosure. The display rack system 200 may include a cardholder 102 removably coupled to a track 204. Although only one cardholder 102 is shown, the display rack system 200 may include a plurality of cardholders 102. Similar to the cardholder 102 for the display rack system 100, the cardholder 102 for the display rack system 200 may a similar construction with the exception that the engagement mechanism 110 is configured to engage the track 204 construction.

The track 204 may include two parallel bars 108 to allow the cardholder 102 to slide along the track 204. In the aspect shown in FIG. 5, the track 204 may have a discorectangular shape. In other aspects, the track 204 may have a circular, elliptical, oval, or another similar shape. The track 204 may be configured to allow a plurality of cardholders 102 to slide around the track 204. In some aspects, the track 204 may be expandable in order to fit into display areas of various sizes and/or allow more/fewer cardholders 102 to fit onto the track 204.

Similar to the aspect described in FIG. 1, the track 204 may be coupled to a support mechanism 114. The support mechanism 114 may include a rear rung 116 having ends 118 and 120 and a plurality of support arms 122. The ends 118 and 120 may be configured to fit into slots 126 located on the vertical rails 128. In the aspect shown in FIG. 5, the ends 118 and 120 are separate from the rear rung 116 that may telescope out from the rear rung telescoping portion 116X to allow the display rack system 200 to expand in size.

Figure 6:
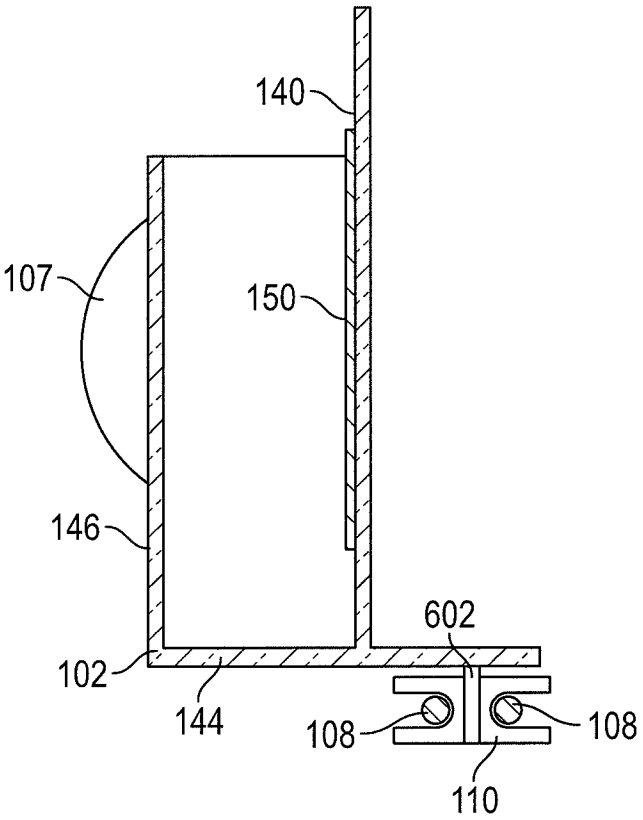
FIG. 6 illustrates exemplary details of a card holder in accordance with another aspect of the disclosure.

FIG. 6 illustrates exemplary details of a card holder in accordance with another aspect of the disclosure. In particular, the cardholder 102 may include an engagement mechanism 110 that may couple the cardholder 102 to the track 104, 204. In this configuration, the engagement mechanism 110 may simply slide along the track 104, 204. Alternatively, the engagement mechanism 110 may include a plurality of wheels to contact the track 104, 204 to reduce friction and make sliding of the cardholder 102 with respect to the track 104, 204 easier. The engagement mechanism 110 may be secured to the cardholders 102 by a thumbwheel, screw, mechanical fastener, or another securement method known in the art. In one aspect, the engagement mechanism 110 may include an attachment 602 connecting the cardholder 102 to the engagement mechanism 110. If the engagement mechanism 110 is implemented as a wheel, the attachment 602 may be implemented as an axle allowing the wheel to rotate there about.

Figure 7:
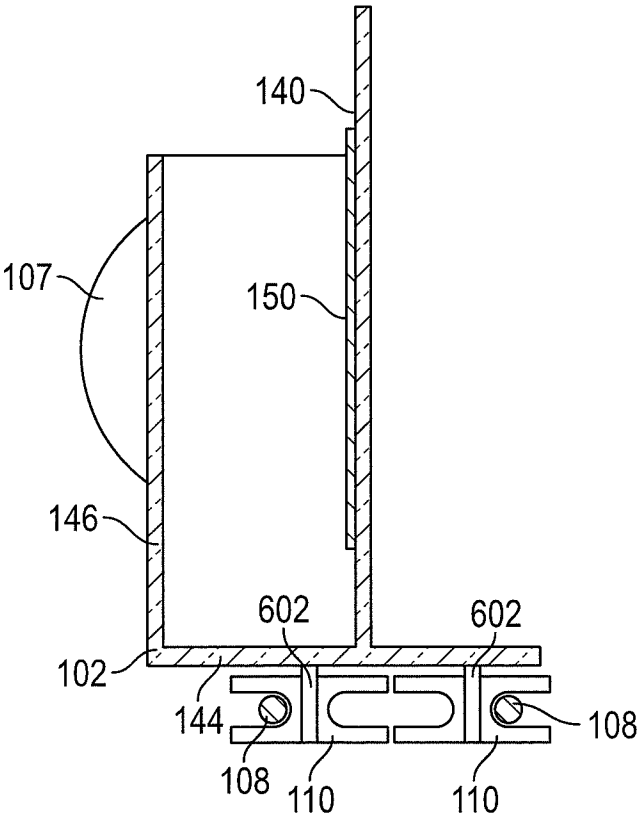
FIG. 7 illustrates exemplary details of a card holder in accordance with another aspect of the disclosure.

FIG. 7 illustrates exemplary details of a card holder in accordance with another aspect of the disclosure. In particular, the cardholder 102 may include two engagement mechanisms 110 that may couple the cardholder 102 to the track 104, 204. If the engagement mechanism 110 is implemented as two wheels, attachments 602 may be implemented as axles allowing the wheels to rotate there about.

Figure 8:
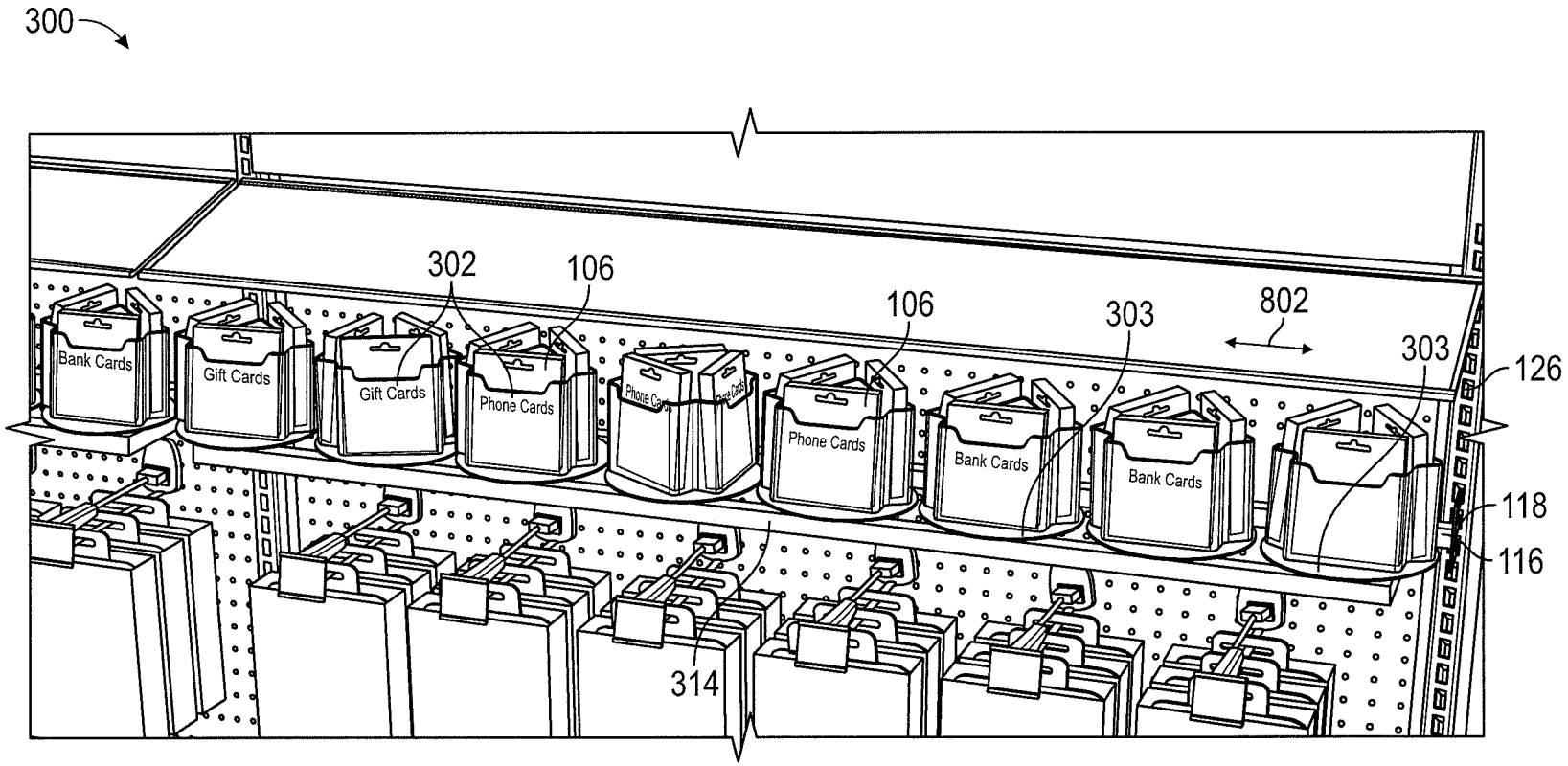
FIG. 8 illustrates a display rack system in accordance with yet another aspect of the disclosure.

FIG. 8 illustrates a display rack system 300 according to yet another aspect of the present disclosure. The display rack system 300 may include a plurality of cardholders 302 located on a plurality of carousels 303. In the aspect shown in FIG. 8, each carousel 303 includes three cardholders 302. In other aspects, there may be fewer than or more than three cardholders 302 coupled to each carousel 303. The carousels 303 may have a circular, triangular, square, rectangular, or other similar shape. The carousels 303 may include bearings to allow the carousels 303 to individually rotate and allow different display items 106 placed in the cardholders 302 to be viewed by a customer.

The carousels 303 may be mounted onto a support mechanism 314. The carousels 303 may be removable and coupled to the support mechanism 314 using a mechanical fastener or another securement mechanism known in the art. The carousels 303 may be individually removed from the support mechanism 314 without disassembling the display rack system 300.

Similar to the aspect described in FIG. 1, the support mechanism 314 may include a rear rung 116 having ends 118 and 120 and a plurality of support arms. The ends 118 and 120 may be configured to fit into slots 126 located on the vertical rails 128. In one aspect, the ends 118 and 120 are separate from the rear rung 116 that may telescope out from a rear rung telescoping portion to allow the display rack system 300 to expand in size. Likewise, the support mechanism 314 may also telescope along the direction of arrow 802.

Figure 9:
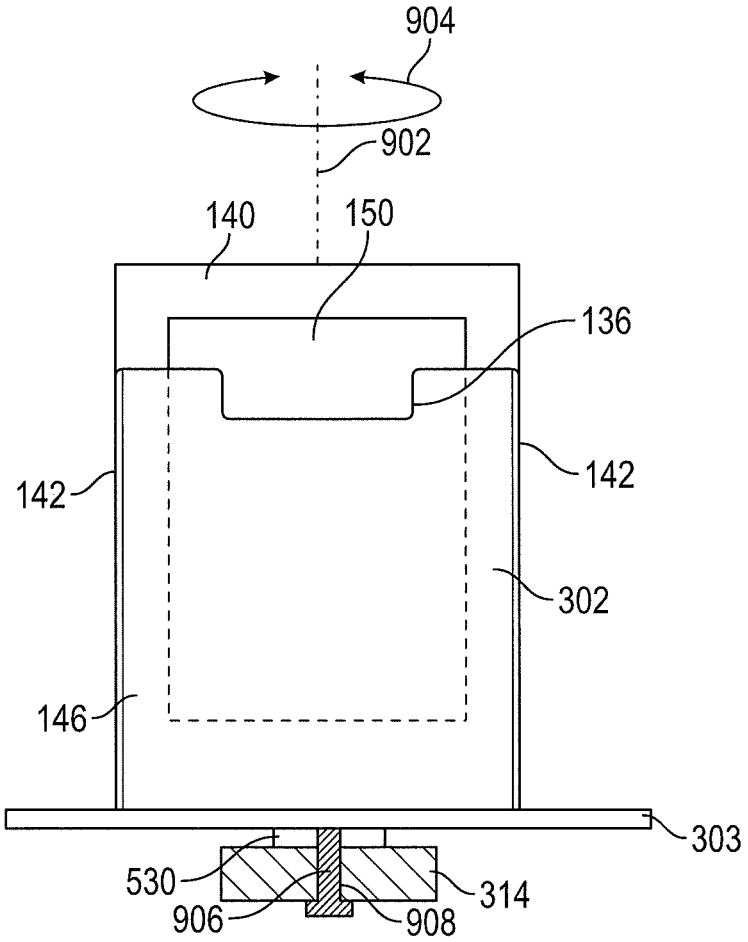
FIG. 9 illustrates exemplary details of a card holder in accordance with the FIG. 8 aspect of the disclosure.

FIG. 9 illustrates exemplary details of a card holder in accordance with another aspect of the disclosure. In particular, the cardholder 302 may include an engagement mechanism 530 that may couple the cardholder 302 to the support mechanism 314. In this configuration, the engagement mechanism 530 may include bearings that allow the free rotation of the cardholder 302 with respect to the support mechanism 314 about axis 902 as shown by arrow 904. The engagement mechanism 530 may be secured to the cardholders 302 by an axle 906 that connects the carousel 303 through the engagement mechanism 530 to the support mechanism 314. The engagement mechanism may be implemented together with a thumbwheel, screw, mechanical fastener, or another securement method known in the art. The carousels 303 may also slide with a linear-motion as shown by arrow 802 in FIG. 8. In this regard, the support mechanism 314 may include a slot 908 allowing the axle 906 to translate along the slot 908 to provide displacement as shown by the arrow 802.

Accordingly, as described herein the display rack system shown in FIGS. 1-9 holds a plurality of items in a limited space. Moreover, the display rack system shown in FIGS. 1-9 allows customers access to all of the items.

While disclosure has been described in terms of what are presently considered to be specific aspects, the disclosure need not be limited to the disclosed aspects. It is intended to cover various modifications and similar arrangements included within the spirit and scope of the claims, the scope of which should be accorded the broadest interpretation so as to encompass all such modifications and similar structures. The present disclosure includes any and all aspects of the following claims.

The invention claimed is:

1. A display rack system, comprising:

a support mechanism having a rear rung and the rear rung having a first end and a second end, the support mechanism configured to be attached to a vertical surface at the first end and the second end;

a plurality of cardholders removably attached to the support mechanism;

the plurality of cardholders being arranged at a same vertical height along the support mechanism between the first end and the second end;

a plurality of rotation mechanisms, each of the plurality of rotation mechanisms configured to hold at least one of the plurality of cardholders, each of the plurality of rotation mechanisms configured to allow at least one of the plurality of cardholders to separately rotate with respect to the support mechanism;

each of the plurality of cardholders having a front surface, a back surface, side surfaces, and a bottom surface; and a plurality of carousel portions each configured to support one of the plurality of cardholders and the plurality of carousel portions being arranged at a same vertical height along the support mechanism between the first end and the second end, wherein each of the plurality of carousel portions comprise a base and the plurality of cardholders are mounted to the base;

wherein the front surface and the back surface are connected by the side surfaces, and the front surface, the back surface, and the side surfaces being connected to the bottom surface;

wherein the plurality of cardholders are configured to hold cards between the front surface, the back surface, the side surfaces, and the bottom surface; and wherein at least one of the plurality of cardholders is configured to slide with a linear motion along the support mechanism.

2. The display rack system of claim 1, wherein at least one of the plurality of cardholders includes a handle portion extending from the front surface; and wherein the front surface of at least one of the plurality of cardholders comprises an open section arranged between the side surfaces.

3. The display rack system of claim 1, wherein at least one of the plurality of cardholders is configured to hold a sign on the back surface.

4. The display rack system of claim 1, wherein the plurality of cardholders are configured with an open top to hold cards between the front surface, the back surface, the side surfaces, and the bottom surface; and wherein at least one of the plurality of cardholders includes a handle portion extending from the front surface.

5. The display rack system of claim 1, wherein at least one of the plurality of cardholders includes a handle portion comprising a flat surface extending from the front surface of at least one of the plurality of cardholders; and wherein the plurality of cardholders are configured with an open top to hold cards between the front surface, the back surface, the side surfaces, and the bottom surface.

6. The display rack system of claim 1, wherein each of the plurality carousel portions being configured to connect to one of the plurality of rotation mechanisms; and wherein each of the plurality of carousel portions comprise a circular shape.

7. The display rack system of claim 1, wherein the plurality of cardholders are configured with an open section in the front surface, the open section configured to facilitate viewing of items located within the plurality of cardholders; and wherein at least one of the plurality of cardholders includes a handle portion comprising a flat surface extending from the front surface of at least one of the plurality of cardholders.

8. The display rack system of claim 1, wherein the plurality of cardholders comprise a transparent material in at least the front surface; and wherein the plurality of cardholders are configured with an open top to hold cards between the front surface, the back surface, the side surfaces, and the bottom surface.

9. The display rack system of claim 1, wherein the base comprises a circular base and the plurality of cardholders are mounted to the circular base; and wherein the first end and the second end of the support mechanism further comprise ends configured to fit into slots associated with the vertical surface.

10. The display rack system of claim 1, wherein the support mechanism is expandable in a telescoping manner; and wherein the plurality of cardholders comprise a transparent material in at least the front surface.

11. The display rack system of claim 1, wherein the first end and the second end of the support mechanism further comprise ends configured to fit into slots associated with the vertical surface.

12. A display rack system, comprising:

a support mechanism having a rear rung and the rear rung having a first end and a second end, the support mechanism configured to be attached to a vertical surface at the first end and the second end;

a plurality of cardholders removably attached to the support mechanism;

the plurality of cardholders being arranged at a same vertical height along the support mechanism between the first end and the second end;

a plurality of rotation mechanisms, each of the plurality of rotation mechanisms configured to hold a plurality of the plurality of cardholders, each of the plurality of rotation mechanisms configured to allow at least one of the plurality of cardholders to separately rotate with respect to the support mechanism;

each of the plurality of cardholders having a front surface, a back surface, side surfaces, and a bottom surface; and a plurality of carousel portions each configured to support one of the plurality of cardholders and the plurality of carousel portions being arranged at a same vertical height along the support mechanism between the first end and the second end, wherein each of the plurality of carousel portions comprise a base and the plurality of cardholders are mounted to the base;

wherein the plurality of cardholders are configured to hold cards between the front surface, the back surface, the side surfaces, and the bottom surface;

wherein the plurality of cardholders are configured with an open top to hold cards between the front surface, the back surface, the side surfaces, and the bottom surface; and wherein at least one of the plurality of cardholders is configured to slide with a linear motion along the support mechanism.

13. The display rack system of claim 12, wherein at least one of the plurality of cardholders includes a handle portion extending from the front surface.

14. The display rack system of claim 12, wherein the front surface and the back surface are connected by the side surfaces, and the front surface, the back surface, and the side surfaces are connected to the bottom surface; and wherein at least one of the plurality of cardholders is configured to hold a sign on the back surface.

15. The display rack system of claim 12, wherein at least one of the plurality of cardholders is configured to hold a sign on the back surface; and wherein each of the plurality of carousel portions comprise a circular shape.

16. The display rack system of claim 12, wherein at least one of the plurality of cardholders includes a handle portion comprising a flat surface extending from the front surface of at least one of the plurality of cardholders; and wherein the plurality of cardholders comprise a transparent material in at least the front surface.

17. The display rack system of claim 12 wherein:

the support mechanism is expandable in a telescoping manner; and the first end and the second end of the support mechanism further comprise ends configured to fit into slots associated with the vertical surface.

18. The display rack system of claim 12, wherein the base comprises a circular base and the plurality of cardholders are mounted to the circular base; and wherein the first end and the second end of the support mechanism further comprise ends configured to fit into slots associated with the vertical surface.

19. The display rack system of claim 12, wherein each of the plurality carousel portions is configured to connect to one of the plurality of rotation mechanisms; and wherein the plurality of cardholders comprise a transparent material in at least the front surface.

20. The display rack system of claim 19, wherein the plurality of cardholders are configured with an open section in the front surface, the open section configured to facilitate viewing of items located within the plurality of cardholders; and wherein the plurality of cardholders comprise a transparent material in at least the front surface.

* * * * *